US011536496B2

(12) United States Patent
Higashiiue et al.

(10) Patent No.: US 11,536,496 B2
(45) Date of Patent: Dec. 27, 2022

(54) HEAT EXCHANGER AND REFRIGERATION CYCLE APPARATUS

(71) Applicant: Mitsubishi Electric Corporation, Tokyo (JP)

(72) Inventors: Shinya Higashiiue, Tokyo (JP); Shigeyoshi Matsui, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/271,086

(22) PCT Filed: Oct. 29, 2018

(86) PCT No.: PCT/JP2018/040101
§ 371 (c)(1),
(2) Date: Feb. 24, 2021

(87) PCT Pub. No.: WO2020/089966
PCT Pub. Date: May 7, 2020

(65) Prior Publication Data

US 2021/0215409 A1 Jul. 15, 2021

(51) Int. Cl.
*F25B 39/02* (2006.01)
*F28F 9/02* (2006.01)
(Continued)

(52) U.S. Cl.
CPC ..... *F25B 39/022* (2013.01); *F28F 9/02* (2013.01); *F28D 2021/0071* (2013.01); *F28F 1/022* (2013.01)

(58) Field of Classification Search
CPC ..... F25B 39/022; F28F 9/02; F28F 9/0221; F28F 9/028; F28F 9/001; F28D 2021/0071
(Continued)

(56) References Cited

U.S. PATENT DOCUMENTS 4,611,474 A * 9/1986 Musinski ..... F25B 39/022 62/51.1
5,172,761 A * 12/1992 Lyon ..... F28D 1/05366 165/173
(Continued)

FOREIGN PATENT DOCUMENTS

JP 2004069228 A 3/2004
JP 2006194522 A 7/2006
JP 2018044759 A 3/2018

OTHER PUBLICATIONS

International Search Report of the International Searching Authority dated Jan. 15, 2019, for the corresponding International Application No. PCT/US 2018-040101 (and English Machine Translation).

*Primary Examiner* — Tho V Duong
*Assistant Examiner* — Raheena R Malik
(74) *Attorney, Agent, or Firm* — Posz Law Group, PLC

(57) ABSTRACT

A heat exchanger includes flat tubes, a header, and a refrigerant inlet. The header has a first plate, a second plate, and a third plate. The first plate has a ridge portion defining a tank space. The second plate has a first flow passage and a second flow passage. The first flow passage extends in such a manner that an area of the first flow passage coincides with an area of the tank space. The second flow passage extends in such a manner that an area of the second flow passage does not coincide with the area of the tank space. An upper portion of the first flow passage and an upper portion of the second flow passage are connected to each other via a first connecting flow passage. A lower portion of the first flow passage and a lower portion of the second flow passage are connected to each other via a second connecting flow passage. The third plate has a communicating hole that allows the first flow passage and each of the flat tubes to communicate with each other.

4 Claims, 8 Drawing Sheets

(51) Int. Cl.
*F28D 21/00* (2006.01)
*F28F 1/02* (2006.01)

(58) Field of Classification Search
USPC ..... 165/173
See application file for complete search history.

(56) References Cited

U.S. PATENT DOCUMENTS 5,236,042 A * 8/1993 Kado ..... F28F 9/0243 165/149
5,251,694 A * 10/1993 Chigira ..... F28F 9/0224 165/173
5,295,532 A * 3/1994 Hughes ..... F28D 1/05391 165/173
5,366,007 A * 11/1994 Hutto ..... F28F 9/0246 165/173
5,538,079 A * 7/1996 Pawlick ..... F28F 9/0131 165/173
5,553,664 A * 9/1996 Nishishita ..... F28D 1/0341 165/173
6,827,139 B2 * 12/2004 Kawakubo ..... F28F 9/0243 165/173
7,367,203 B2 * 5/2008 Katoh ..... F28F 9/0204 62/515
7,481,266 B2 * 1/2009 Demuth ..... F28D 1/0478 165/172
7,571,761 B2 * 8/2009 Katoh ..... F28F 9/0221 165/174
7,607,473 B2 * 10/2009 Ichiyanagi ..... F28F 9/0278 165/173
7,637,314 B2 * 12/2009 Park ..... F28F 9/0221 165/174
7,654,108 B2 * 2/2010 Ishizaka ..... F28F 9/262 165/172
7,775,267 B2 * 8/2010 Higashiyama ..... F28F 17/005 165/173
7,784,530 B2 * 8/2010 Ohashi ..... F28F 9/001 228/183
7,836,943 B2 * 11/2010 Valenzuela ..... H01L 23/473 165/173
7,886,811 B2 * 2/2011 Higashiyama ..... F28F 9/0246 165/173
2005/0039901 A1 * 2/2005 Demuth ..... F28F 9/0278 165/173
2005/0235691 A1 * 10/2005 Katoh ..... F28D 1/05391 62/515
2005/0284621 A1 * 12/2005 Katoh ..... F28F 9/0221 165/174
2006/0162917 A1 * 7/2006 Park ..... F28F 9/0221 62/509
2007/0131392 A1 * 6/2007 Minami ..... F28D 1/05391 165/110
2007/0131398 A1 * 6/2007 Ichiyanagi ..... F28F 9/0221 165/110
2007/0204983 A1 * 9/2007 Ichiyanagi ..... F25B 9/008 165/173
2008/0017364 A1 * 1/2008 Ichiyanagi ..... F28F 9/0209 165/173
2008/0314076 A1 * 12/2008 Ichiyanagi ..... F25B 9/008 165/173
2016/0076823 A1 * 3/2016 Okazaki ..... F28F 9/0221 165/174
2016/0076824 A1 * 3/2016 Matsuda ..... F28F 9/0278 165/174
2016/0076825 A1 * 3/2016 Matsuda ..... F28D 1/05366 137/561 A
2016/0116231 A1 * 4/2016 Higashiiue ..... F28D 1/0476 165/174
2016/0169595 A1 * 6/2016 Matsuda ..... F28F 9/0221 165/104.21
2016/0178292 A1 * 6/2016 Matsui ..... F25B 39/022 165/104.21
2016/0195335 A1 * 7/2016 Nishiyama ..... F28D 1/05366 165/174
2016/0202000 A1 * 7/2016 Higashiiue ..... F28F 9/0275 165/104.21
2016/0231067 A1 * 8/2016 Dittly ..... F28F 9/0224
2016/0245560 A1 * 8/2016 Higashiiue ..... F28F 9/0278
2016/0245596 A1 * 8/2016 Higashiiue ..... F28F 9/0221
2017/0241683 A1 * 8/2017 Ito ..... F28F 9/0278
2017/0241684 A1 * 8/2017 Ito ..... F25B 13/00
2017/0328652 A1 * 11/2017 Matsui ..... F28D 1/05366
2018/0073820 A1 * 3/2018 Higashiiue ..... F28D 1/05375
2018/0216858 A1 * 8/2018 Higashiiue ..... F28F 13/08
2019/0033018 A1 * 1/2019 Higashiiue ..... F25B 39/022
2019/0093965 A1 * 3/2019 Higashiiue ..... F28D 1/0435
2019/0154365 A1 * 5/2019 Hayashi ..... B23K 1/00
2019/0170456 A1 * 6/2019 Matsui ..... F28F 9/0221
2020/0018528 A1 * 1/2020 Akaiwa ..... F28F 9/0278
2020/0025427 A1 * 1/2020 Higashiiue ..... F25B 39/00
2020/0072507 A1 * 3/2020 Higashiiue ..... F25B 39/028
2021/0003353 A1 * 1/2021 Akaiwa ..... F28F 9/02
2021/0018233 A1 * 1/2021 Higashiiue ..... F28F 9/02
2021/0140692 A1 * 5/2021 Akaiwa ..... F25B 39/04
2021/0215409 A1 * 7/2021 Higashiiue ..... F28F 9/02

* cited by examiner

HEAT EXCHANGER AND REFRIGERATION CYCLE APPARATUS

CROSS REFERENCE TO RELATED APPLICATION

This application is a U.S. national stage application of PCT/JP2018/040101 filed on Oct. 29, 2018, the contents of which are incorporated herein by reference.

TECHNICAL FIELD

The present disclosure relates to a heat exchanger and a refrigeration cycle apparatus including a plurality of flat tubes and a header.

BACKGROUND ART

Patent Literature 1 describes a heat exchanger. The heat exchanger includes a plurality of flat tubes aligned in an up-down direction and extending parallel to each other in a horizontal direction, and a pair of header tanks extending in the up-down direction and each connected to a corresponding one of both ends of each of the flat tubes. The header tank is composed of a joining plate having elongated holes into which the flat tubes are inserted to join the flat tubes to the joining plate, a communicating plate having communicating holes whose positions correspond to the positions of the respective elongated holes of the joining plate, and a tank plate in which a refrigerant passage having a semicylindrical shape is formed.

CITATION LIST

Patent Literature

Patent Literature 1: Japanese Unexamined Patent Application Publication No. 2004-69228

SUMMARY OF INVENTION

Technical Problem

When the heat exchanger in Patent Literature 1 is used as a refrigerant evaporator, two-phase gas-liquid refrigerant flows into the header tank provided to an inlet of the heat exchanger. When a refrigerant inlet is disposed at a lower portion of the header tank, the two-phase gas-liquid refrigerant that has flowed into the header tank flows upward in the header tank and is distributed to the flat tubes. However, in this case, liquid refrigerant, which has a density higher than does gas refrigerant, remains in an upper portion of the inside of the header tank because of an inertial force. For this reason, the amount of the refrigerant distributed to the flat tubes increases as the position of the flat tubes becomes higher. Thus, a problem remains in that the amounts of the refrigerant distributed to the flat tubes are uneven.

The present disclosure is made to solve such a problem, and an object of the present disclosure is to provide a heat exchanger and a refrigeration cycle apparatus that are capable of more evenly distributing refrigerant to a plurality of flat tubes.

Solution to Problem

A heat exchanger according to an embodiment of the present disclosure includes a plurality of flat tubes aligned in an up-down direction, extending parallel to each other, and each allowing refrigerant to flow through the flat tube; a header extending in the up-down direction and connected to an end of each of the plurality of flat tubes; and a refrigerant inlet formed at a lower portion of the header. The header has a first plate, a second plate placed between the first plate and the plurality of flat tubes, and a third plate placed between the second plate and the plurality of flat tubes. The first plate has a ridge portion defining a tank space that communicates with the refrigerant inlet and that extends in the up-down direction. The second plate has a first flow passage and a second flow passage. The first flow passage passes through the second plate in a direction of a thickness of the second plate, and extends in the up-down direction in such a manner that an area of the first flow passage coincides with an area of the tank space when the first flow passage is viewed from the direction of the thickness of the second plate. The second flow passage passes through the second plate in the direction of the thickness of the second plate, and extends along the first flow passage in the up-down direction in such a manner that an area of the second flow passage does not coincide with the area of the tank space when the second flow passage is viewed from the direction of the thickness of the second plate. An upper portion of the first flow passage and an upper portion of the second flow passage are connected to each other via a first connecting flow passage. A lower portion of the first flow passage and a lower portion of the second flow passage are connected to each other via a second connecting flow passage formed at a lower position than a position of the first connecting flow passage. The third plate has at least one communicating hole that passes through the third plate in a direction of a thickness of the third plate and allows the first flow passage and each of the plurality of flat tubes to communicate with each other.

A refrigeration cycle apparatus according to another embodiment of the present disclosure includes a heat exchanger according to an embodiment of the present disclosure.

Advantageous Effects of Invention

According to an embodiment of the present disclosure, the liquid refrigerant that is in the two-phase gas-liquid refrigerant flowing through the first flow passage and that has reached the upper portion of the first flow passage without being distributed to any of the plurality of flat tubes passes through the first connecting flow passage, the second flow passage, and the second connecting flow passage and then returns to the lower portion of the first flow passage. Thus, it is possible to prevent liquid refrigerant from remaining in the upper portion of the first flow passage. As a result, according to an embodiment of the present disclosure, it is possible to more evenly distribute refrigerant to the plurality of flat tubes.

DESCRIPTION OF EMBODIMENTS

Embodiment 1

Figure 1:
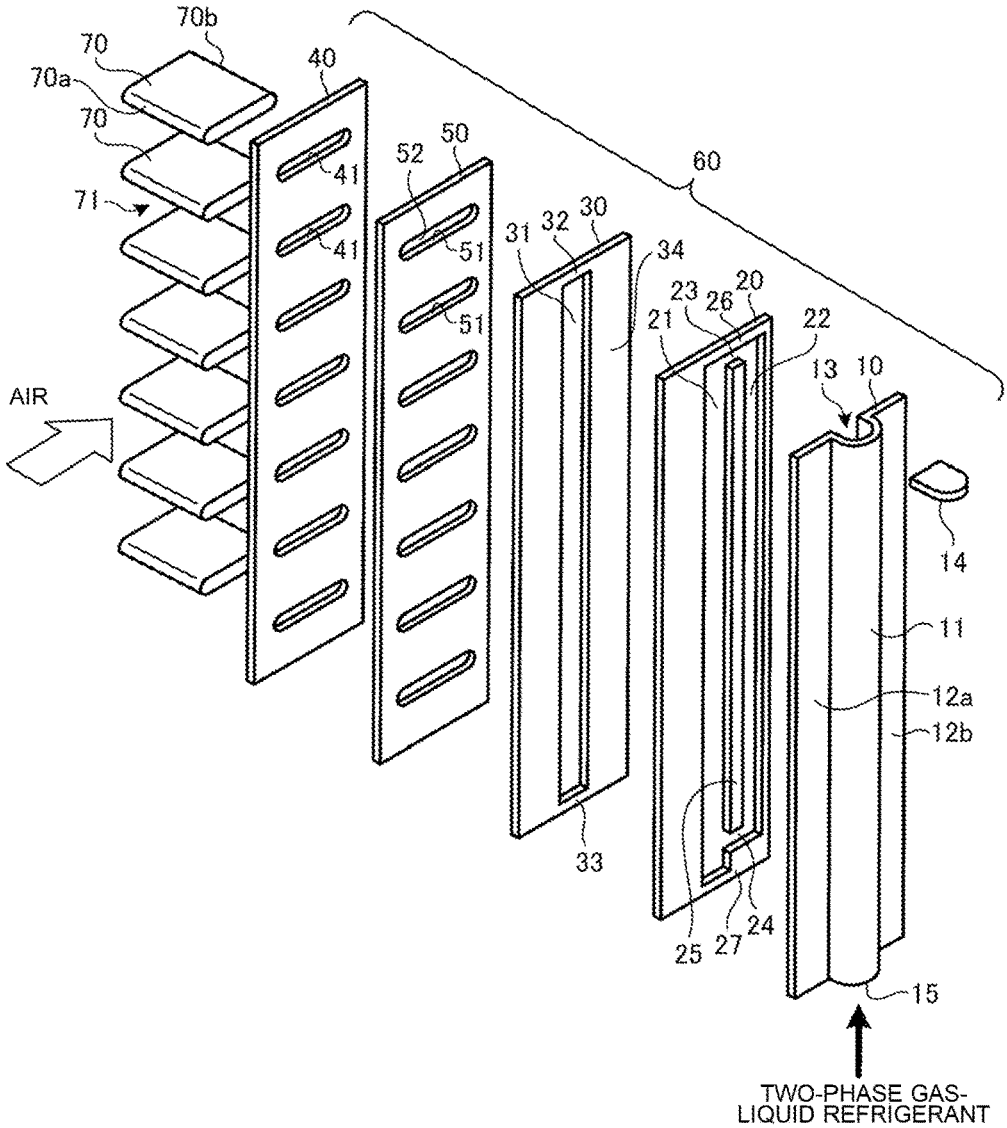
FIG. 1 is an exploded perspective view illustrating the configuration of a part of a heat exchanger according to Embodiment 1 of the present disclosure.

A heat exchanger according to Embodiment 1 of the present disclosure will be described. FIG. 1 is an exploded perspective view illustrating the configuration of a part of the heat exchanger according to Embodiment 1. An up-down direction in FIG. 1 is a vertical direction. The heat exchanger according to Embodiment 1 is an air heat exchanger that exchanges heat between air and refrigerant and is at least used as an evaporator of a refrigeration cycle apparatus. In the following drawings including FIG. 1, white arrows represent airflow directions. In the specification, positional relationships between components, directions in which the components extend, and directions in which the components are aligned are, in principle, interpreted as ones in a case in which the heat exchanger is installed in a usable state.

As illustrated in FIG. 1, the heat exchanger includes a plurality of flat tubes 70, each of which allows refrigerant to flow through the flat tube 70, a header 60, which is connected to one end of each of the flat tubes 70 in the direction in which the flat tubes 70 extend, and a refrigerant inlet 15, which is formed at a lower portion of the header 60. The flat tubes 70 each extend in a horizontal direction. The flat tubes 70 are aligned in the up-down direction and extend parallel to each other. The header 60 extends in the up-down direction in the direction in which the flat tubes 70 are aligned. A space 71, which is an airflow passage, is defined between adjacent two of the flat tubes 70. A heat transfer fin may be disposed between adjacent two of the flat tubes 70. A header collecting pipe (not illustrated) having, for example, a cylindrical shape is connected to the other end of each of the flat tubes 70 in the direction in which the flat tubes 70 extend. When the heat exchanger is used as an evaporator of a refrigeration cycle apparatus, refrigerant flows from the one end toward the other end of each of the flat tubes 70. When the heat exchanger is used as a condenser of a refrigeration cycle apparatus, refrigerant flows from the other end toward the one end of each of the flat tubes 70.

Figure 2:
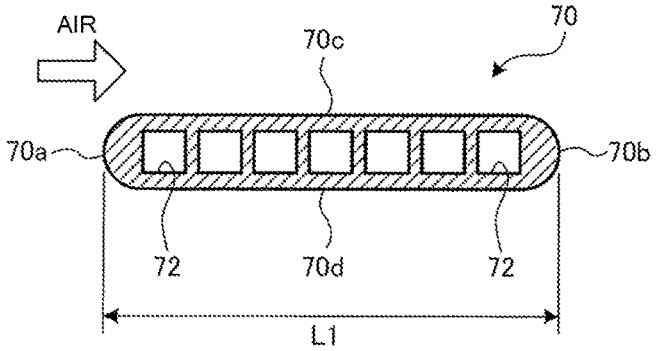
FIG. 2 is a sectional view illustrating the shape of a flat tube 70 of the heat exchanger according to Embodiment 1 of the present disclosure.

FIG. 2 is a sectional view illustrating the shape of the flat tube 70 of the heat exchanger according to Embodiment 1. FIG. 2 illustrates a section perpendicular to the direction in which the flat tube 70 extends. As illustrated in FIG. 2, the flat tube 70 has a sectional shape that is flat in a single direction, such as an elliptical shape. The flat tube 70 has a first side end portion 70*a*, a second side end portion 70*b*, and a pair of flat surfaces 70*c* and 70*d*. In the section illustrated in FIG. 2, the first side end portion 70*a* is continuous with one end portion of the flat surface 70*c* and one end portion of the flat surface 70*d*. In the same section, the second side end portion 70*b* is continuous with the other end portion of the flat surface 70*c* and the other end portion of the flat surface 70*d*. The first side end portion 70*a* is a side end portion disposed windward in a direction in which air flows and passes through the heat exchanger. That is, the first side end portion 70*a* is a leading edge of the flat tube 70. The second side end portion 70*b* is a side end portion leeward in a direction in which air flows and passes through the heat exchanger. That is, the second side end portion 70*b* is a trailing edge of the flat tube 70. Hereinafter, the direction that is perpendicular to the direction in which the flat tube 70 extends and that is along the flat surfaces 70*c* and 70*d* may be referred to as the major-axis direction of the flat tube 70. In FIG. 2, the major-axis direction of the flat tube 70 is a left-right direction. The major-axis length of the flat tube 70 in the major-axis direction is L1.

The flat tube 70 has a plurality of refrigerant passages 72, which are aligned, in the major-axis direction, between the first side end portion 70*a* and the second side end portion 70*b*. That is, the flat tube 70 is a flat multi-hole tube having the refrigerant passages 72. The refrigerant passages 72 are each formed to extend parallel to the direction in which the flat tube 70 extends.

With reference back to FIG. 1, the header 60 has a first plate 10, a second plate 20, a third plate 30, a fourth plate 40, and a fifth plate 50. The first plate 10, the second plate 20, the third plate 30, the fourth plate 40, and the fifth plate 50 are each made of a flat metal plate and each have a strip shape elongated in a single direction. The outlines of the first plate 10, the second plate 20, the third plate 30, the fourth plate 40, and the fifth plate 50 are identical. The first plate 10, the second plate 20, the third plate 30, the fourth plate 40, and the fifth plate 50 are placed in such a manner that the directions of the thicknesses of the plates are each parallel to the direction in which the flat tube 70 extends, that is, in such a manner that the plate surfaces of the plates are each perpendicular to the direction in which the flat tube 70 extends.

The header 60 has a configuration in which the first plate 10, the second plate 20, the third plate 30, the fifth plate 50, and the fourth plate 40 are layered in this order from the farthest from the flat tubes 70. The first plate 10 is farthest from the flat tubes 70. The fifth plate 50 is not closest to the flat tubes 70, and the fourth plate 40 is closest to the flat tubes 70. The second plate 20 is placed between the first plate 10 and the flat tubes 70 and is adjacent to the first plate 10. The third plate 30 is placed between the second plate 20 and the flat tubes 70 and is adjacent to the second plate 20. The fifth plate 50 is placed between the third plate 30 and the flat tubes 70 and is adjacent to the third plate 30. The fourth plate 40 is placed between the fifth plate 50 and the flat tubes 70 and is adjacent to the fifth plate 50, The one end of each of the flat tubes 70 is connected to the fourth plate 40. Adjacent ones of the first plate 10, the second plate 20, the third plate 30, the fifth plate 50, and the fourth plate 40 are joined by soldering. The first plate 10, the second plate 20, the third plate 30, the fifth plate 50, and the fourth plate 40 are placed in such a manner that the long-side directions of the plates are each in the up-down direction.

Figure 3:
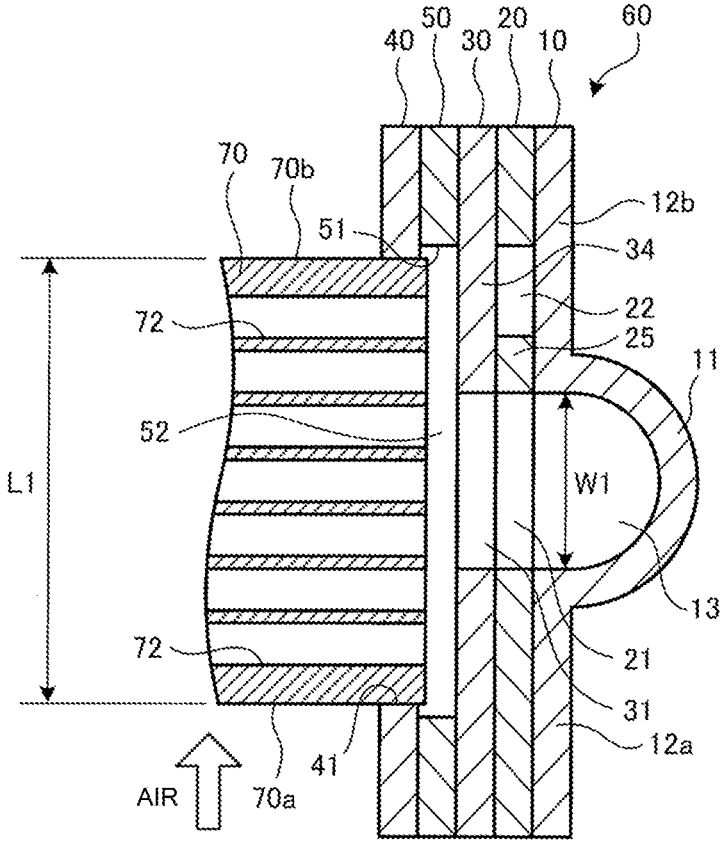
FIG. 3 is a sectional view illustrating the configuration of a header 60 of the heat exchanger according to Embodiment 1 of the present disclosure.

FIG. 3 is a sectional view illustrating the configuration of the header 60 of the heat exchanger according to Embodiment 1. FIG. 3 illustrates a section parallel to the major-axis direction of the flat tube 70 and to the direction in which the flat tube 70 extends. Each of the directions of the thicknesses of the first plate 10, the second plate 20, the third plate 30, the fifth plate 50, and the fourth plate 40 is a left-right direction in FIG. 3. Each of the short-side directions of the first plate 10, the second plate 20, the third plate 30, the fifth plate 50, and the fourth plate 40 is an up-down direction in FIG. 3.

As illustrated in FIGS. 1 and 3, the first plate 10 has a ridge portion 11, which ridges in a direction away from the flat tubes 70. The ridge portion 11 extends, in the long-side direction of the first plate 10, from one end of the first plate 10 in the long-side direction to the other end of the first plate 10 in the long-side direction. The ridge portion 11 has a sectional shape such as a semicircular shape, a semioval shape, and a semielliptical shape. The ridge portion 11 is formed at the center of the first plate 10 in the short-side direction. In addition, the first plate 10 has a pair of flat portions 12*a* and 12*b*, which are each formed into a flat shape with the ridge portion 11 interposed between the flat portions 12*a* and 12*b*. The flat portions 12*a* and 12*b* each extend, in the long-side direction of the first plate 10, from the one end of the first plate 10 in the long-side direction to the other end of the first plate 10 in the long-side direction.

The ridge portion 11 defines, inside the ridge portion 11, a tank space 13, which extends in the up-down direction in the long-side direction of the first plate 10. The tank space 13 has a sectional shape such as a semicircular shape, a semioval shape, and a semielliptical shape. That is, the tank space 13 is a space defined into a semicylindrical shape, a semioval cylindrical shape, or a semielliptical cylindrical shape. The tank space 13 communicates with the refrigerant inlet 15. The direction of the width of the tank space 13 is parallel to the short-side direction of the first plate 10. A width W1 of the tank space 13 in the direction of the width of the tank space 13 is smaller than the major-axis length L1 of the flat tube 70 (W1<L1). When the shape of the tank space 13 is a semicylindrical shape, a semioval cylindrical shape, or a semielliptical cylindrical shape, the internal capacity of the tank space 13 can be smaller than that of a tank space having a cylindrical shape. In addition, when the width W1 of the tank space 13 is smaller than the major-axis length L1 of the flat tube 70, the internal capacity of the tank space 13 can be even smaller. Thus, it is possible to reduce the amount of refrigerant in a refrigeration cycle apparatus including the heat exchanger in Embodiment 1.

When the tank space 13 is viewed from the direction of the thickness of the first plate 10, the tank space 13 extends to cross each of the flat tubes 70. In addition, when the tank space 13 is viewed from the direction of the thickness of the first plate 10, the center of the tank space 13 in the direction of the width of the tank space 13 coincides with the center of each of the flat tubes 70 in the major-axis direction. An upper end portion of the tank space 13 is closed by a closing part 14. The refrigerant inlet 15 is disposed at a lower end portion of the tank space 13. When the heat exchanger is used as an evaporator, the refrigerant inlet 15 allows two-phase gas-liquid refrigerant to flow upward into the tank space 13. When the heat exchanger is used as a condenser, the liquid refrigerant in the tank space 13 flows out downward via the refrigerant inlet 15.

The second plate 20 has a first flow passage 21 and a second flow passage 22. The first flow passage 21 passes through the second plate 20 in the direction of the thickness of the second plate 20 and extends in the up-down direction in the long-side direction of the second plate 20. The upper end of the first flow passage 21 does not reach the upper end of the second plate 20 and is closed by an upper frame portion 26, which is a part of the second plate 20. The lower end of the first flow passage 21 does not reach the lower end of the second plate 20 and is closed by a lower frame portion 27, which is a part of the second plate 20. The first flow passage 21 is disposed in such a manner that the area of the first flow passage 21 coincides with the area of the tank space 13 when the first flow passage 21 is viewed from the direction of the thickness of the second plate 20. The first flow passage 21 may be disposed in such a manner that the entire area of the first flow passage 21 coincides with the area of the tank space 13 when the first flow passage 21 is viewed from the direction of the thickness of the second plate 20. The width of the first flow passage 21 may be equal to the width W1 of the tank space 13. The first flow passage 21, together with the tank space 13, is used as an upward flow passage that allows the two-phase gas-liquid refrigerant that has flowed from the refrigerant inlet 15 to flow upward through the first flow passage 21. When the first flow passage 21 is viewed from the direction of the thickness of the second plate 20, the center of the first flow passage 21 in the direction of the width of the first flow passage 21 coincides with the center of each of the flat tubes 70 in the major-axis direction.

The second flow passage 22 passes through the second plate 20 in the direction of the thickness of the second plate 20 and extends along the first flow passage 21 in the up-down direction. The upper end of the second flow passage 22 does not reach the upper end of the second plate 20 and is closed by the upper frame portion 26. The lower end of the second flow passage 22 does not reach the lower end of the second plate 20 and is closed by the lower frame portion 27. The second flow passage 22 is disposed in such a manner that the area of the second flow passage 22 does not coincide with the area of the tank space 13 when the second flow passage 22 is viewed from the direction of the thickness of the second plate 20. The passage width of the second flow passage 22 in the short-side direction of the second plate 20 is equal to or smaller than the passage width of the first flow passage 21 in the same direction. The second flow passage 22 is used as a downward flow passage that allows liquid refrigerant to flow downward through the second flow passage 22. In the header 60 illustrated in FIGS. 1 and 3, the second flow passage 22 is disposed leeward of the first flow passage 21. The second flow passage 22 may be disposed windward of the first flow passage 21.

The first flow passage 21 and the second flow passage 22 are partitioned off by a partition part 25, which extends in the up-down direction. As a component separate from the second plate 20, the partition part 25 is made of a flat metal plate having a thickness equal to the thickness of the second plate 20. The partition part 25 may be integrally formed with the first plate 10 or the third plate 30. The first plate 10 and the third plate 30 are each a component adjacent to the second plate 20.

In addition, the second plate 20 has a first connecting flow passage 23, which is formed between the upper end of the partition part 25 and the upper frame portion 26, and a second connecting flow passage 24, which is formed between the lower end of the partition part 25 and the lower frame portion 27. The first connecting flow passage 23 and the second connecting flow passage 24 each pass through the second plate 20 in the direction of the thickness of the second plate 20 and extend in the short-side direction of the second plate 20. An upper portion of the first flow passage 21 and an upper portion of the second flow passage 22 are connected to each other via the first connecting flow passage 23. When the first connecting flow passage 23 is viewed from the direction of the thickness of the second plate 20, the first connecting flow passage 23 is positioned higher than the highest one of the flat tubes 70. The second connecting flow passage 24 is formed at a lower position than the position of the first connecting flow passage 23. A lower portion of the first flow passage 21 and a lower portion of the second flow passage 22 are connected to each other via the second connecting flow passage 24. When the second connecting flow passage 24 is viewed from the direction of the thickness of the second plate 20, the second connecting flow passage 24 is positioned lower than the lowest one of the flat tubes 70. The passage width of the first connecting flow passage 23 in the up-down direction in FIG. 1 is equal to or larger than the passage width of the second connecting flow passage 24 in the same direction. The first connecting flow passage 23 and the second connecting flow passage 24, together with the first flow passage 21 and the second flow passage 22, form a circulation flow passage that allows refrigerant to circulate through the circulation flow passage. With this configuration, the refrigerant that has flowed upward through the first flow passage 21 or the tank space 13 and reached the upper end portion of the first flow passage 21 passes through the first connecting flow passage 23, the second flow passage 22, and the second connecting flow passage 24 and then returns to the lower portion of the first flow passage 21.

At least one of the first connecting flow passage 23 and the second connecting flow passage 24 may be formed in the third plate 30. In this case, the partition part 25 and the second plate 20 can be integrally formed with each other. Thus, the number of components of the header 60 can be reduced. That is, one of the first connecting flow passage 23 and the second connecting flow passage 24 is formed in one of the second plate 20 and the third plate 30 and the other one of the first connecting flow passage 23 and the second connecting flow passage 24 is formed in the other one of the second plate 20 and the third plate 30.

The third plate 30 has a communicating hole 31. The communicating hole 31 passes through the third plate 30 in the direction of the thickness of the third plate 30 and extends in the up-down direction in the long-side direction of the third plate 30. The upper end of the communicating hole 31 does not reach the upper end of the third plate 30 and is closed by an upper frame portion 32, which is a part of the third plate 30. The lower end of the communicating hole 31 does not reach the lower end of the third plate 30 and is closed by a lower frame portion 33, which is a part of the third plate 30. The communicating hole 31 is disposed in such a manner that the area of the communicating hole 31 coincides with the area of the first flow passage 21 of the second plate 20 when the communicating hole 31 is viewed from the direction of the thickness of the third plate 30. The communicating hole 31 may be disposed in such a manner that the entire area of the communicating hole 31 coincides with the area of the first flow passage 21 when the communicating hole 31 is viewed from the direction of the thickness of the third plate 30. The width of the communicating hole 31 may be equal to the width of the first flow passage 21. When the communicating hole 31 is viewed from the direction of the thickness of the third plate 30, the center of the communicating hole 31 in the direction of the width of the communicating hole 31 coincides with the center of each of the flat tubes 70 in the major-axis direction. The first flow passage 21 of the second plate 20 and each of the flat tubes 70 communicate with each other via the communicating hole 31.

In addition, the third plate 30 has a closing portion 34, which has a flat shape. The closing portion 34 corresponds to the part of the third plate 30 whose area coincides with the area of the second flow passage 22 of the second plate 20 when the closing portion 34 is viewed from the direction of the thickness of the third plate 30. The space between the second flow passage 22 and each of the flat tubes 70 is closed by the closing portion 34. The closing portion 34 is used to prevent the second flow passage 22 and each of the flat tubes 70 from directly communicating with each other and allows the second flow passage 22 and each of the flat tubes 70 to communicate with each other via the first flow passage 21.

The fourth plate 40 has a plurality of insertion holes 41. The one end of each of the flat tubes 70 is inserted into a corresponding one of the insertion holes 41. The insertion holes 41 each pass through the fourth plate 40 in the direction of the thickness of the fourth plate 40. The insertion holes 41 are aligned in the up-down direction in the long-side direction of the fourth plate 40 and extend parallel to each other. The insertion hole 41 has a flat opening shape similar to the circumferential shape of the flat tube 70. The circumferential surfaces of the flat tubes 70 are joined to the corresponding entire perimeters of the opening ends of the insertion holes 41 by soldering.

The fifth plate 50, which is placed between the third plate 30 and the fourth plate 40, has a plurality of through holes 51. The through holes 51 each pass through the fifth plate 50 in the direction of the thickness of the fifth plate 50. The through holes 51 are each independently disposed in such a manner that the positions of the through holes 51 correspond to the positions of the respective flat tubes 70. The through holes 51 are aligned in the up-down direction in the long-side direction of the fifth plate 50 and extend parallel to each other. The through hole 51 has a flat opening shape similar to the circumferential shape of the flat tube 70. The opening area of each of the through holes 51 is equal to or larger than the opening area of each of the insertion holes 41 of the fourth plate 40. When the through holes 51 are viewed in the direction in which the flat tube 70 extends, the opening ends of the through holes 51 coincide with the corresponding circumferential surfaces of the flat tubes 70 or extend around the corresponding circumferential surfaces. An insertion space 52 is defined inside each of the through holes 51 in such a manner that the positions of the insertion spaces 52 correspond to the positions of the respective flat tubes 70. The one end of each of the flat tubes 70 passes through a corresponding one of the insertion holes 41 of the fourth plate 40 and reaches a corresponding one of the insertion spaces 52, The opening ends of the refrigerant passages 72 formed at the one end of each of the flat tubes 70 face a corresponding one of the insertion spaces 52. The refrigerant passages 72 of each of the flat tubes 70 each communicate with the first flow passage 21 and the tank space 13 via a corresponding one of the insertion spaces 52 and the communicating hole 31. When each of the flat tubes 70 does not pass through a corresponding one of the insertion holes 41 of the fourth plate 40, and the one end of each of the flat tubes 70 is positioned inside a corresponding one of the insertion holes 41, the insertion space faced by the opening ends of the refrigerant passages 72 is formed in each of the insertion holes 41. In this case, the fifth plate 50 can be omitted from the components of the header 60.

Next, the operation of the heat exchanger according to Embodiment 1 will be described in an example in which the heat exchanger is used as an evaporator of a refrigeration cycle apparatus. The two-phase gas-liquid refrigerant decompressed by a pressure reducing device flows into the heat exchanger used as an evaporator. First, the two-phase gas-liquid refrigerant that flows into the heat exchanger flows into the tank space 13 of the header 60 from the refrigerant inlet 15. The two-phase gas-liquid refrigerant that has flowed into the tank space 13 flows upward through the tank space 13 and the first flow passage 21, which are used as the upward flow passage, and is then distributed to the flat tubes 70 via the communicating hole 31 and the respective insertion spaces 52.

In this case, because of an inertial force, some liquid refrigerant in the two-phase gas-liquid refrigerant flowing through the tank space 13 and the first flow passage 21 reaches the upper end portion of the tank space 13 and the upper end portion of the first flow passage 21 without being distributed to any of the flat tubes 70. The liquid refrigerant that has reached the upper end portion of the tank space 13 and the upper end portion of the first flow passage 21 passes through the first connecting flow passage 23 and flows into the second flow passage 22. The liquid refrigerant that has flowed into the second flow passage 22 flows downward through the second flow passage 22, passes through the second connecting flow passage 24, and then returns to the lower portion of the first flow passage 21. The liquid refrigerant that has returned to the lower portion of the first flow passage 21 joins the two-phase gas-liquid refrigerant that has flowed into the tank space 13 from the refrigerant inlet 15, flows upward through the tank space 13 and the first flow passage 21 again, and is distributed to the flat tubes 70.

The two-phase gas-liquid refrigerant distributed to the flat tubes 70 flows through any of the refrigerant passages 72 and evaporates into gas refrigerant by exchanging heat with air. The gas refrigerant flows out toward a compressor in a refrigerant circuit via the header collecting pipe disposed at the other ends of the flat tubes 70.

As described above, the liquid refrigerant that has reached the upper end portion of the tank space 13 and the upper end portion of the first flow passage 21 passes through the first connecting flow passage 23, the second flow passage 22, and the second connecting flow passage 24 and then returns to the lower portion of the first flow passage 21. This circulation results in a reduction in the amount of liquid refrigerant remaining in the upper end portion of the tank space 13 and the upper end portion of the first flow passage 21. Thus, it is possible to reduce the amount of refrigerant distributed to the flat tubes 70 located in high positions and to thus more evenly distribute refrigerant to the flat tubes 70.

As described above, the heat exchanger according to Embodiment 1 includes the flat tubes 70, which are aligned in the up-down direction and extend parallel to each other and each of which allows refrigerant to flow through the flat tube 70, the header 60, which extends in the up-down direction and is connected to the one end of each of the flat tubes 70, and the refrigerant inlet 15, which is formed at the lower portion of the header 60. The header 60 has the first plate 10, the second plate 20, which is placed between the first plate 10 and the flat tubes 70, and the third plate 30, which is placed between the second plate 20 and the flat tubes 70. The first plate 10 has the ridge portion 11, which defines the tank space 13 communicating with the refrigerant inlet 15 and extending in the up-down direction. The second plate 20 has the first flow passage 21 and the second flow passage 22. The first flow passage 21 passes through the second plate 20 in the direction of the thickness of the second plate 20. The first flow passage 21 extends in the up-down direction in such a manner that the area of the first flow passage 21 coincides with the area of the tank space 13 when the first flow passage 21 is viewed from the direction of the thickness of the second plate 20. The second flow passage 22 passes through the second plate 20 in the direction of the thickness of the second plate 20. The second flow passage 22 extends along the first flow passage 21 in the up-down direction in such a manner that the area of the second flow passage 22 does not coincide with the area of the tank space 13 when the second flow passage 22 is viewed from the direction of the thickness of the second plate 20. The upper portion of the first flow passage 21 and the upper portion of the second flow passage 22 are connected to each other via the first connecting flow passage 23. The lower portion of the first flow passage 21 and the lower portion of the second flow passage 22 are connected to each other via the second connecting flow passage 24, which is formed at a lower position than the position of the first connecting flow passage 23. The third plate 30 has at least one communicating hole 31, which passes through the third plate 30 in the direction of the thickness of the third plate 30 and allows the first flow passage 21 and each of the flat tubes 70 to communicate with each other.

With this configuration, the liquid refrigerant that is in the two-phase gas-liquid refrigerant flowing upward through the first flow passage 21 and that has reached the upper portion of the first flow passage 21 without being distributed to any of the flat tubes 70 passes through the first connecting flow passage 23, the second flow passage 22, and the second connecting flow passage 24 and then returns to the lower portion of the first flow passage 21. This configuration can prevent liquid refrigerant from remaining in the upper end portion of the first flow passage 21. Thus, with the configuration, it is possible to more evenly distribute refrigerant to the flat tubes 70. Accordingly, it is possible to improve the heat-exchanger performance of the heat exchanger. As a result, it is possible to improve the operating efficiency of a refrigeration cycle apparatus including the heat exchanger and to thus achieve energy saving in the refrigeration cycle apparatus.

In addition, in the configuration, the first flow passage 21 and the second flow passage 22 are each formed in the second plate 20. This configuration enables the first flow passage 21 and the second flow passage 22 to be disposed flush with each other. Thus, it is possible to prevent an increase in the thickness of the header 60 in the direction of the thickness of the header 60. As a result, with the configuration, it is possible to improve the heat-exchanger performance of the heat exchanger with the size of the heat exchanger reduced.

Embodiment 2

Figure 4:
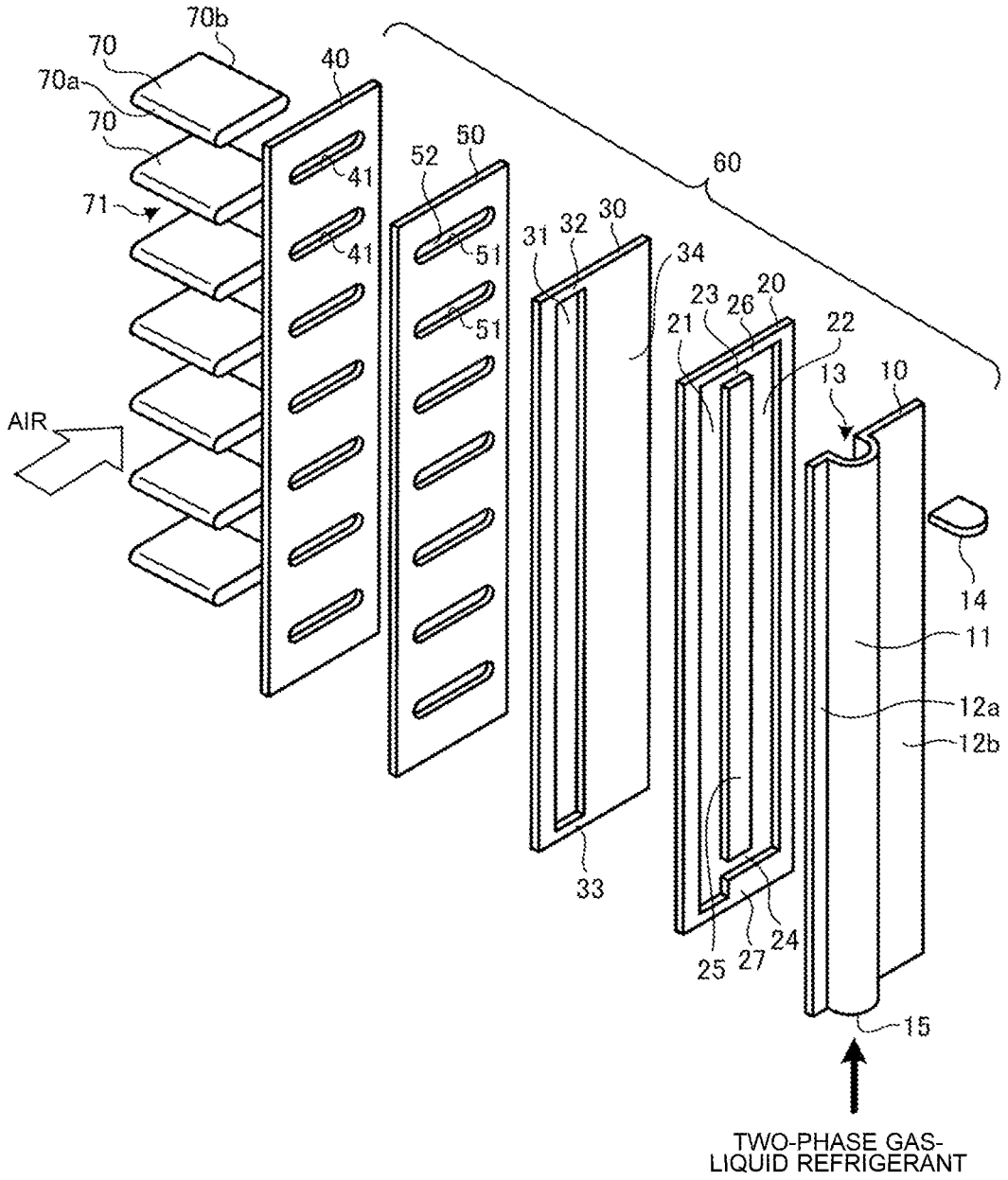
FIG. 4 is an exploded perspective view illustrating the configuration of a part of a heat exchanger according to Embodiment 2 of the present disclosure.
Figure 5:
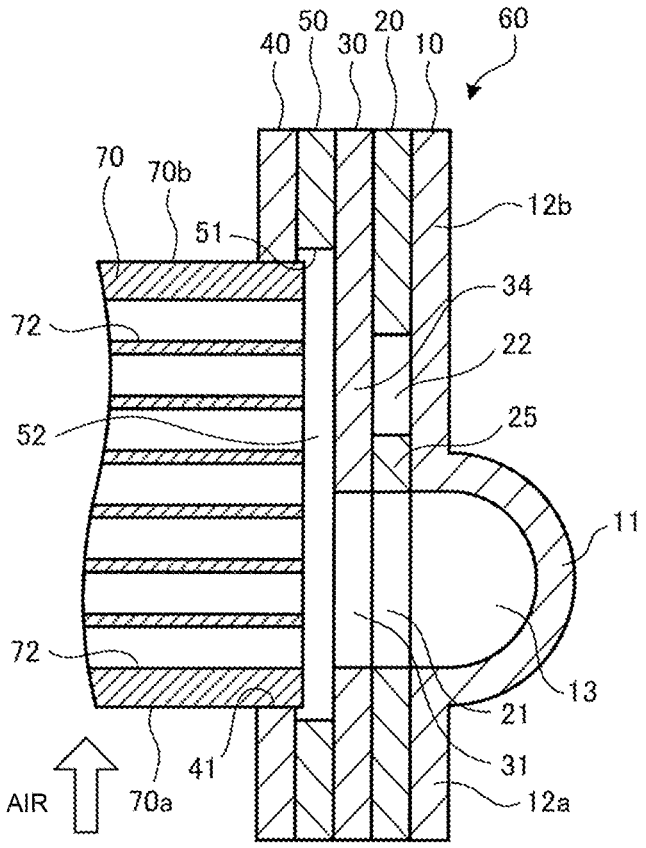
FIG. 5 is a sectional view illustrating the configuration of a header 60 of the heat exchanger according to Embodiment 2 of the present disclosure.

A heat exchanger according to Embodiment 2 of the present disclosure will be described. FIG. 4 is an exploded perspective view illustrating the configuration of a part of the heat exchanger according to Embodiment 2. FIG. 5 is a sectional view illustrating the configuration of the header 60 of the heat exchanger according to Embodiment 2. FIG. 5 illustrates a section corresponding to the section in FIG. 3. The components having the same functions and effects as those in Embodiment 1 have the same reference signs and are not described.

As illustrated in FIGS. 4 and 5, in Embodiment 2, the ridge portion 11 of the first plate 10 is formed windward of the center of the first plate 10 in the short-side direction. Thus, when the tank space 13 is viewed from the direction of the thickness of the first plate 10, the center of the tank space 13 in the direction of the width of the tank space 13 is disposed windward of the center of each of the flat tubes 70 in the major-axis direction.

The first flow passage 21 of the second plate 20 and the communicating hole 31 of the third plate 30 are disposed in such a manner that the areas of the first flow passage 21 and the communicating hole 31 each coincide with the area of the tank space 13. Thus, when the first flow passage 21 is viewed from the direction of the thickness of the second plate 20, the center of the first flow passage 21 in the direction of the width of the first flow passage 21 is disposed windward of the center of each of the flat tubes 70 in the major-axis direction. Similarly, when the communicating hole 31 is viewed from the direction of the thickness of the third plate 30, the center of the communicating hole 31 in the direction of the width of the communicating hole 31 is disposed windward of the center of each of the flat tubes 70 in the major-axis direction.

The heat transfer coefficient between refrigerant and air at the first side end portion 70*a*, which is a leading edge of the flat tube 70 and is positioned windward, is the highest in the flat tube 70. Thus, when a large amount of refrigerant flows through the refrigerant passages 72 closer to the first side end portion 70*a*, it is possible to promote heat exchange between refrigerant and air and to thus improve the heat exchange efficiency of the heat exchanger used as an evaporator.

As described above, in the heat exchanger according to Embodiment 2, each of the flat tubes 70 is a flat multi-hole tube in which the refrigerant passages 72 are formed. When the tank space 13 is viewed from the direction of the thickness of the first plate 10, the tank space 13 is defined windward of the center of each of the flat tubes 70 in the major-axis direction. This configuration enables a large amount of refrigerant to flow through the refrigerant passages 72 placed windward in each of the flat tubes 70. Thus, it is possible to improve the heat-exchanger performance of the heat exchanger. As a result, it is possible to improve the operating efficiency of a refrigeration cycle apparatus including the heat exchanger and to thus achieve energy saving in the refrigeration cycle apparatus.

Embodiment 3

Figure 6:
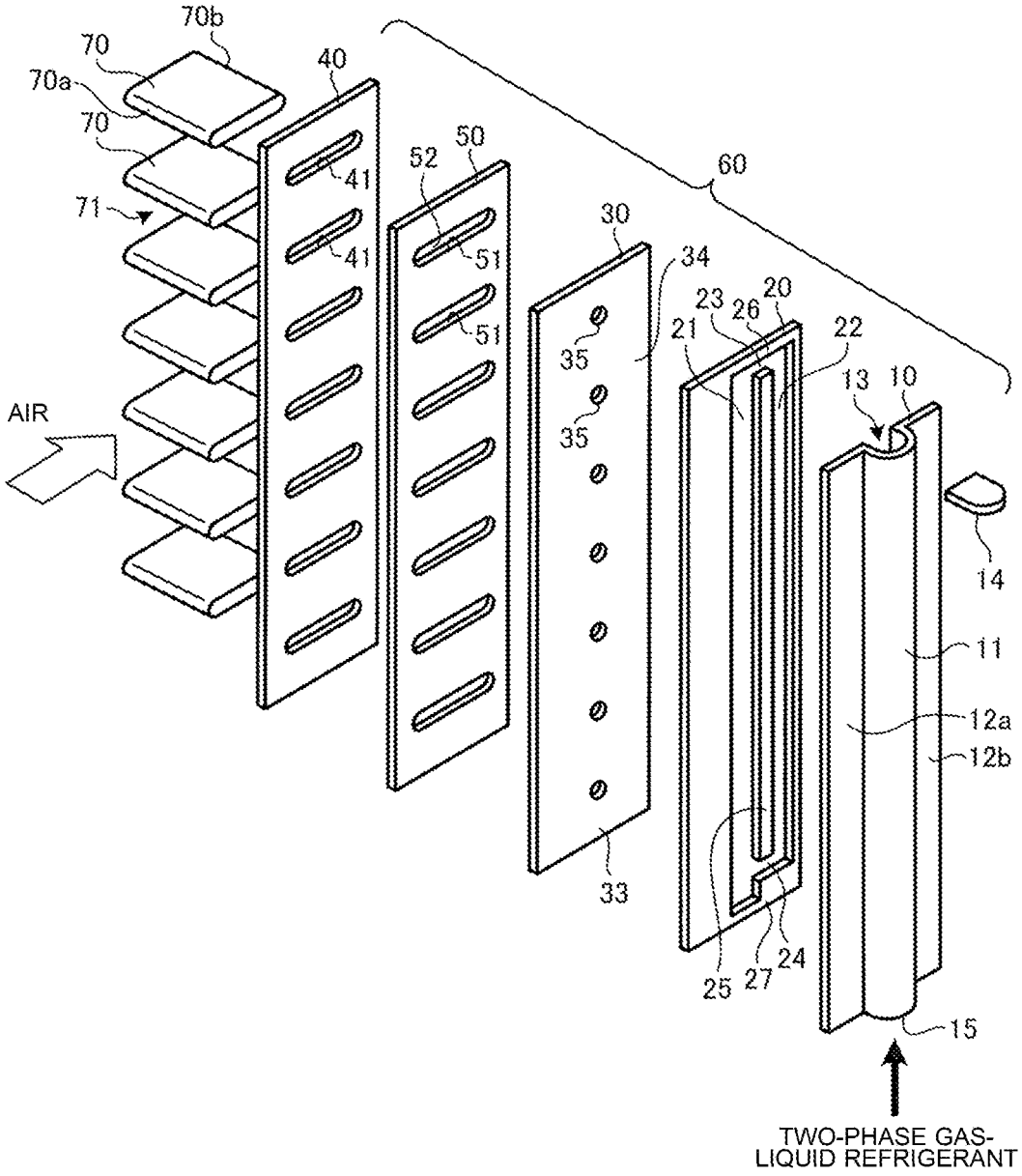
FIG. 6 is an exploded perspective view illustrating the configuration of a part of a heat exchanger according to Embodiment 3 of the present disclosure.
Figure 7:
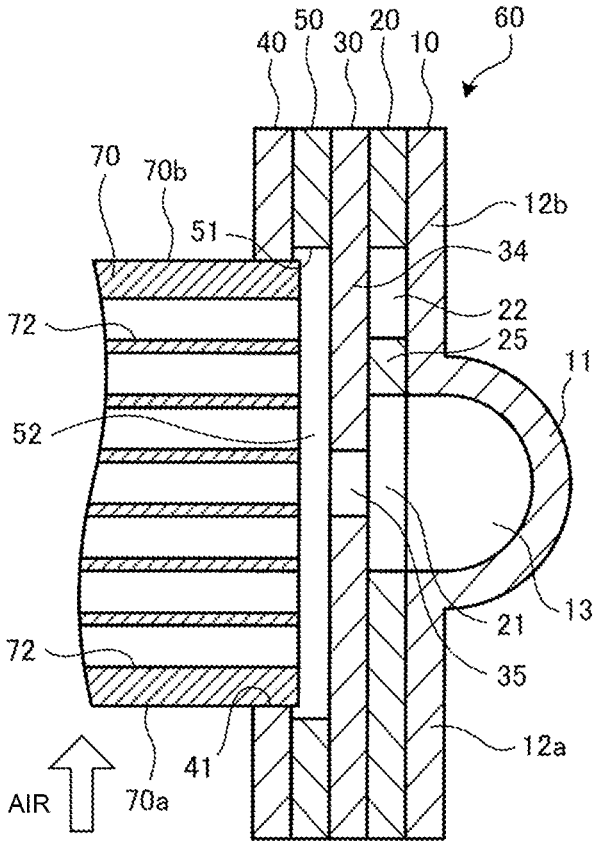
FIG. 7 is a sectional view illustrating the configuration of a header 60 of the heat exchanger according to Embodiment 3 of the present disclosure.

A heat exchanger according to Embodiment 3 of the present disclosure will be described. FIG. 6 is an exploded perspective view illustrating the configuration of a part of the heat exchanger according to Embodiment 3. FIG. 7 is a sectional view illustrating the configuration of the header 60 of the heat exchanger according to Embodiment 3. FIG. 7 illustrates a section corresponding to the section in FIG. 3. The components having the same functions and effects as those in Embodiment 1 have the same reference signs and are not described.

As illustrated in FIGS. 6 and 7, a plurality of communicating holes 35, each of which has a circular opening shape, are provided in the third plate 30 in Embodiment 3. The communicating holes 35 are disposed in such a manner that the positions of the communicating holes 35 correspond to the positions of the respective flat tubes 70. The communicating holes 35 each pass through the third plate 30 in the direction of the thickness of the third plate 30. The communicating holes 35 are aligned in the up-down direction in the long-side direction of the third plate 30. The communicating holes 35 are disposed in such a manner that the area of each of the communicating holes 35 coincides with the area of the first flow passage 21 of the second plate 20 when the communicating holes 35 are viewed from the direction of the thickness of the third plate 30. In addition, the communicating holes 35 are disposed in such a manner that the areas of the communicating holes 35 coincide with the areas of the respective insertion spaces 52 of the fifth plate 50 when the communicating holes 35 are viewed from the direction of the thickness of the third plate 30. In addition, the communicating holes 35 are disposed in such a manner that the areas of the communicating holes 35 coincide with the areas of the respective flat tubes 70 when the communicating holes 35 are viewed from the direction of the thickness of the third plate 30.

The passage sectional area of each of the communicating holes 35 is smaller than the passage sectional area of a corresponding one of the flat tubes 70, that is, the sum of the passage sectional areas of the refrigerant passages 72 formed in the corresponding one of the flat tubes 70. In addition, the passage sectional area of each of the communicating holes 35 is smaller than the opening area of a corresponding one of the through holes 51.

The communicating holes 35 are each used as a restriction hole having high flow resistance in the refrigerant passage between the first flow passage 21 and a corresponding one of the flat tubes 70. When the heat exchanger is used as an evaporator, the pressure in the tank space 13 and the first flow passage 21 increase as each of the communicating holes 35 is used as a restriction hole, and the pressure difference between the pressure in the tank space 13 and the first flow passage 21 and the pressure in each of the insertion spaces 52 thus increases. This pressure difference having thus increased further equalizes the pressure difference between the pressure in the tank space 13 and the first flow passage 21 and the pressure in each of the insertion spaces 52 positioned higher than other insertion spaces 52 with the pressure difference between the pressure in the tank space 13 and the first flow passage 21 and the pressure in each of the insertion spaces 52 positioned lower than other insertion spaces 52. Thus, the refrigerant in the tank space 13 and the first flow passage 21 is evenly distributed to the insertion spaces 52 and as a result evenly distributed to the flat tubes 70.

As described above, in the heat exchanger according to Embodiment 3, at least one communicating hole includes the communicating holes 35. The passage sectional area of each of the communicating holes 35 is smaller than the passage sectional area of a corresponding one of the flat tubes 70. This configuration enables the pressure in the tank space 13 and the first flow passage 21 to increase. Thus, it is possible to evenly distribute refrigerant to the flat tubes 70. Accordingly, it is possible to improve the heat-exchanger performance of the heat exchanger. As a result, it is possible to improve the operating efficiency of a refrigeration cycle apparatus including the heat exchanger and to thus achieve energy saving in the refrigeration cycle apparatus.

Embodiment 4

Figure 8:
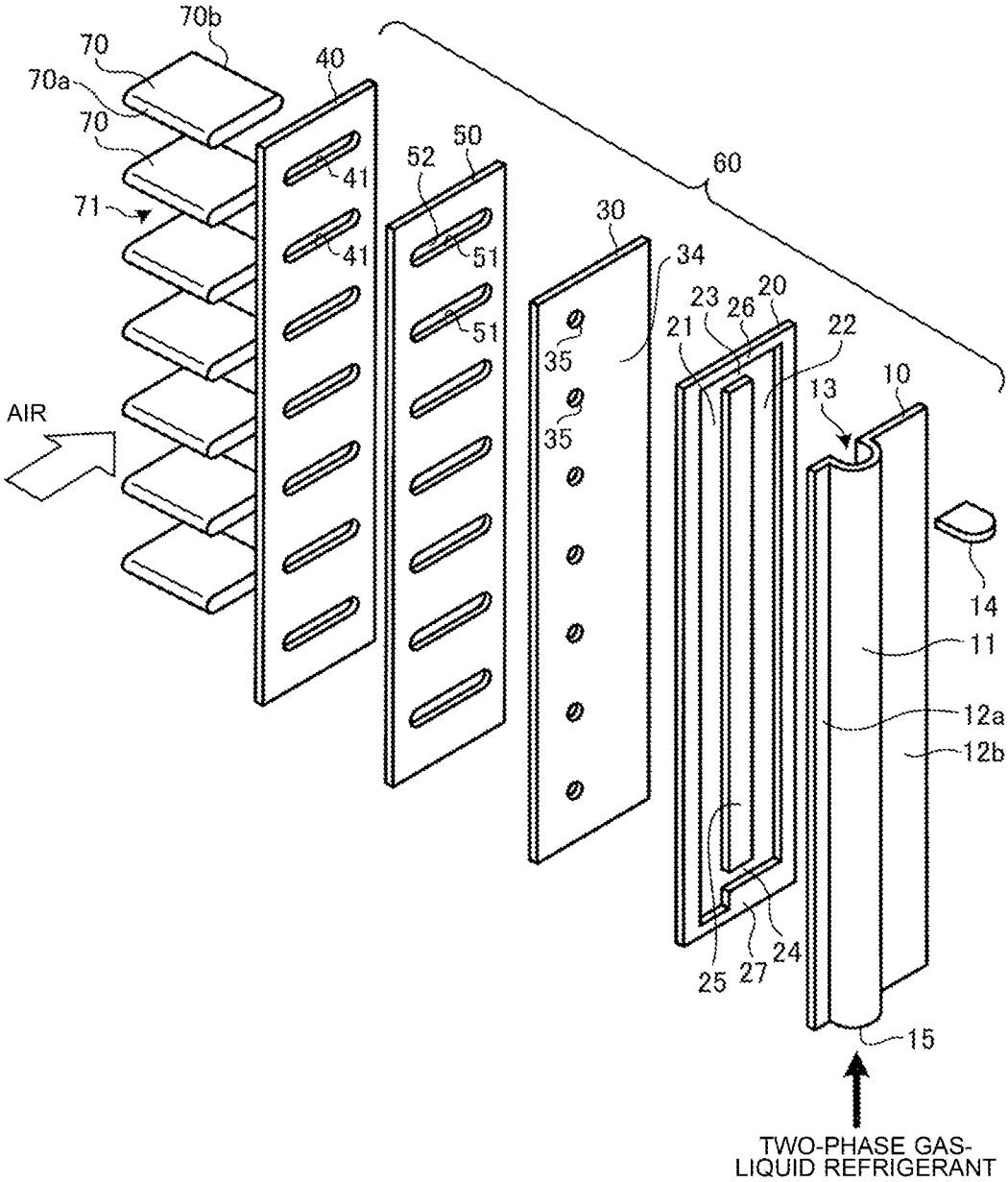
FIG. 8 is an exploded perspective view illustrating the configuration of a part of a heat exchanger according to Embodiment 4 of the present disclosure.

A heat exchanger according to Embodiment 4 of the present disclosure will be described. FIG. 8 is an exploded perspective view illustrating the configuration of a part of the heat exchanger according to Embodiment 4. The components having the same functions and effects as those in any of Embodiment 1 to Embodiment 3 have the same reference signs and are not described.

As illustrated in FIG. 8, similarly to Embodiment 2, the first plate 10 in Embodiment 4 has the ridge portion 11 formed windward. Thus, when the tank space 13 is viewed from the direction of the thickness of the first plate 10, the center of the tank space 13 in the direction of the width of the tank space 13 is disposed windward of the center of each of the flat tubes 70 in the major-axis direction. Similarly to Embodiment 3, the communicating holes 35, each of which has a circular opening shape, are provided in the third plate 30 in Embodiment 4. The communicating holes 35 are placed windward in the third plate 30 in such a manner that the area of each of the communicating holes 35 coincides with the areas of the tank space 13 and the first flow passage 21 when the communicating holes 35 are viewed from the direction of the thickness of the third plate 30. The passage sectional area of each of the communicating holes 35 is smaller than the passage sectional area of a corresponding one of the flat tubes 70.

Embodiment 4 has a configuration in which the configuration in Embodiment 2 and the configuration in Embodiment 3 are combined. Thus, Embodiment 4 can achieve both effects of Embodiment 2 and Embodiment 3. That is, similarly to Embodiment 2, Embodiment 4 enables a large amount of refrigerant to flow through the refrigerant passages 72 placed windward in each of the flat tubes 70. Thus, it is possible to promote heat exchange between refrigerant and air. In addition, similarly to Embodiment 3, Embodiment 4 enables the pressure in the tank space 13 and the first flow passage 21 to increase. Thus, it is possible to evenly distribute refrigerant to the flat tubes 70. Accordingly, Embodiment 4 can further improve the heat-exchanger performance of the heat exchanger.

Embodiment 5

Figure 9:
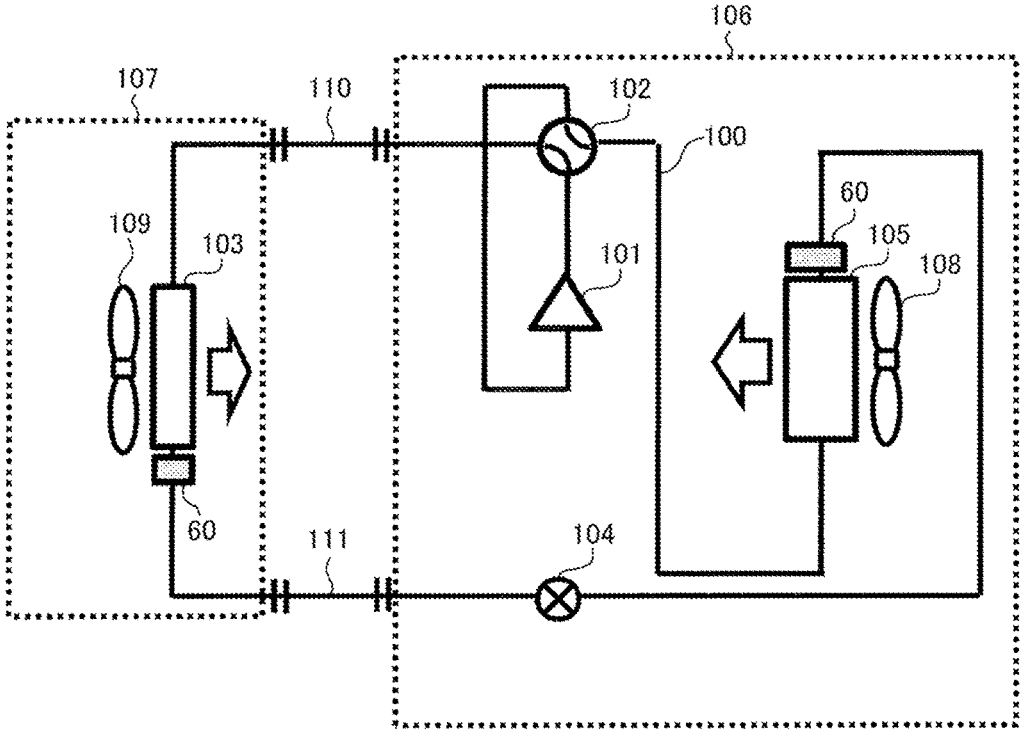
FIG. 9 is a diagram of a refrigerant circuit illustrating the configuration of a refrigeration cycle apparatus according to Embodiment 5 of the present disclosure.

A refrigeration cycle apparatus according to Embodiment 5 of the present disclosure will be described. FIG. 9 is a diagram of a refrigerant circuit illustrating the configuration of the refrigeration cycle apparatus according to Embodiment 5. Although Embodiment 5 illustrates an air-conditioning apparatus as a refrigeration cycle apparatus, the refrigeration cycle apparatus in Embodiment 5 is also applicable to, for example, water heaters. As illustrated in FIG. 9, the refrigeration cycle apparatus includes a refrigerant circuit 100, which includes a compressor 101, a four-way valve 102, an indoor heat exchanger 103, a pressure reducing device 104, and an outdoor heat exchanger 105 connected via refrigerant pipes to form an annular shape. In addition, the refrigeration cycle apparatus includes an outdoor unit 106 and an indoor unit 107. The outdoor unit 106 accommodates the compressor 101, the four-way valve 102, the outdoor heat exchanger 105, the pressure reducing device 104, and an outdoor fan 108, which supplies outdoor air to the outdoor heat exchanger 105. The indoor unit 107 accommodates the indoor heat exchanger 103 and an indoor fan 109, which supplies air to the indoor heat exchanger 103. The outdoor unit 106 and the indoor unit 107 are connected via two extension pipes 110 and 111, each of which is a part of the refrigerant pipes.

The compressor 101 is a fluid machine configured to compress and discharge suctioned refrigerant. The four-way valve 102 is a device configured to switch between a refrigerant passage in a cooling operation and a refrigerant passage in a heating operation under control of a controller (not illustrated). The indoor heat exchanger 103 is a heat exchanger that exchanges heat between refrigerant flowing through the indoor heat exchanger 103 and indoor air supplied from the indoor fan 109. The indoor heat exchanger 103 is used as a condenser in the heating operation and is used as an evaporator in the cooling operation. The pressure reducing device 104 is a device configured to decompress refrigerant. An electronic expansion valve whose opening degree is adjusted under control of a controller is usable as the pressure reducing device 104. The outdoor heat exchanger 105 is a heat exchanger that exchanges heat between refrigerant flowing through the outdoor heat exchanger 105 and air supplied from the outdoor fan 108. The outdoor heat exchanger 105 is used as an evaporator in the heating operation and is used as a condenser in the cooling operation.

Any of the heat exchangers in Embodiment 1 to Embodiment 4 is used as at least one of the outdoor heat exchanger 105 and the indoor heat exchanger 103. The header 60 is preferably placed at a position in the heat exchanger where a large amount of liquid-phase refrigerant flows. Specifically, in a refrigerant flow in the refrigerant circuit 100, the header 60 is preferably provided to an inlet of the heat exchanger used as an evaporator, that is, an outlet of the heat exchanger used as a condenser.

Figure 10:
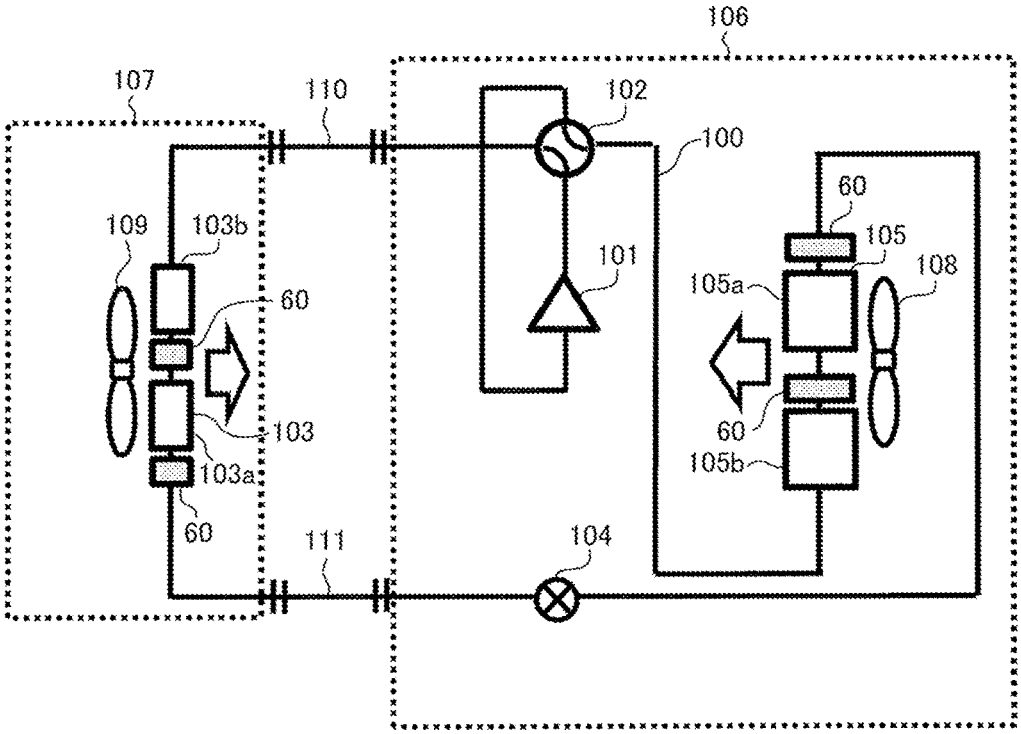
FIG. 10 is a diagram of a refrigerant circuit illustrating the configuration of a refrigeration cycle apparatus according to a modification of Embodiment 5 of the present disclosure.

FIG. 10 is a diagram of a refrigerant circuit illustrating the configuration of a refrigeration cycle apparatus according to a modification of Embodiment 5. As illustrated in FIG. 10, in the modification, the outdoor heat exchanger 105 is divided into a heat exchange unit 105*a* and a heat exchange unit 105*b*. The heat exchange units 105*a* and 105*b* are connected in series in a refrigerant flow. The indoor heat exchanger 103 is divided into a heat exchange unit 103*a* and a heat exchange unit 103*b*. The heat exchange units 103*a* and 103*b* are connected in series in a refrigerant flow.

Also in the modification, the header 60 is preferably placed at a position in the heat exchanger where a large amount of liquid-phase refrigerant flows. Specifically, in a refrigerant flow in the refrigerant circuit 100, the header 60 is preferably provided to each inlet of heat exchange units used as evaporators, among the heat exchange units 105*a*, 105*b*, 103*a*, and 103*b*. In other words, in a refrigerant flow in the refrigerant circuit 100, the header 60 is preferably provided to each outlet of heat exchange units used as condensers, among the heat exchange units 105*a*, 105*b*, 103*a*, and 103*b*.

As described above, the refrigeration cycle apparatus according to Embodiment 5 includes the heat exchanger according to any of Embodiment 1 to Embodiment 4. The header 60 is preferably provided to an inlet of the heat exchanger used as an evaporator. This configuration enables the refrigeration cycle apparatus to provide an effect similar to that of any of Embodiment 1 to Embodiment 4.

It is possible to combine ones of Embodiment 1 to Embodiment 5 described above and implement embodiments thus combined.

REFERENCE SIGNS LIST

10 first plate 11 ridge portion 12*a*, 12*b* flat portion 13 tank space 14 closing part 15 refrigerant inlet 20 second plate 21 first flow passage 22 second flow passage 23 first connecting flow passage 24 second connecting flow passage 25 partition part 26 upper frame portion 27 lower frame portion 30 third plate 31 communicating hole 32 upper frame portion 33 lower frame portion 34 closing portion 35 communicating hole 40 fourth plate 41 insertion hole 50 fifth plate 51 through hole 52 insertion space 60 header 70 flat tube 70*a* first side end portion 70*b* second side end portion 70*c*, 70*d* flat surface 71 space 72 refrigerant passage 100 refrigerant circuit 101 compressor 102 four-way valve 103 indoor heat exchanger 103*a*, 103*b* heat exchange unit 104 pressure reducing device 105 outdoor heat exchanger 105*a*, 105*b* heat exchange unit 106 outdoor unit 107 indoor unit 108 outdoor fan 109 indoor fan 110, 111 extension pipe

The invention claimed is:

1. A heat exchanger, comprising:

a plurality of flat tubes aligned in an up-down direction, extending parallel to each other, and each allowing refrigerant to flow through the flat tube;

a header extending in the up-down direction and connected to an end of each of the plurality of flat tubes; and a refrigerant inlet formed at a lower portion of the header, the header having a first plate, a second plate placed between the first plate and the plurality of flat tubes, and a third plate placed between the second plate and the plurality of flat tubes, the first plate having a single ridge portion defining a tank space that communicates with the refrigerant inlet and that extends in the up-down direction in the direction which the flat tubes are aligned, the second plate having a first flow passage and a second flow passage, the first flow passage passing through the second plate in a direction of a thickness of the second plate, and extending along the single ridge portion in the up-down direction in the direction in which the flat tubes are aligned in such a manner that an area of the first flow passage coincides with an area of the tank space when the first flow passage is viewed from the direction of the thickness of the second plate, the second flow passage passing through the second plate in the direction of the thickness of the second plate, and extending along the first flow passage and the single ridge portion in the up-down direction in the direction in which the flat tubes are aligned in such a manner that an area of the second flow passage does not coincide with the area of the tank space when the second flow passage is viewed from the direction of the thickness of the second plate, an upper portion of the first flow passage and an upper portion of the second flow passage being connected to each other via a first connecting flow passage, a lower portion of the first flow passage and a lower portion of the second flow passage being connected to each other via a second connecting flow passage formed at a lower position than a position of the first connecting flow passage, the third plate having at least one communicating hole that passes through the third plate in a direction of a thickness of the third plate and allows the first flow passage and each of the plurality of flat tubes to communicate with each other.

2. The heat exchanger of claim 1, wherein each of the plurality of flat tubes is a flat multi-hole tube, and when the tank space is viewed from a direction of a thickness of the first plate, the tank space is defined windward of a center of each of the plurality of flat tubes in a major-axis direction of the flat tube.

3. The heat exchanger of claim 1, wherein the at least one communicating hole comprises a plurality of communicating holes, and a passage sectional area of each of the plurality of communicating holes is smaller than a passage sectional area of a corresponding one of the plurality of flat tubes.

4. A refrigeration cycle apparatus comprising the heat exchanger of claim 1.

* * * * *